US011636829B2

(12) United States Patent
Kim et al.

(10) Patent No.: US 11,636,829 B2
(45) Date of Patent: Apr. 25, 2023

(54) DISPLAY DEVICE AND METHOD OF DRIVING THE SAME

(71) Applicant: Samsung Display Co., Ltd., Yongin-si (KR)

(72) Inventors: Ji Hye Kim, Yongin-si (KR); Jae Hyeon Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/789,083

(22) Filed: Feb. 12, 2020

(65) Prior Publication Data

US 2020/0286451 A1 Sep. 10, 2020

(30) Foreign Application Priority Data

Mar. 6, 2019 (KR) ..... 10-2019-0025751

(51) Int. Cl.
*G09G 5/38* (2006.01)
*G09G 5/10* (2006.01)

(52) U.S. Cl.
CPC ..... *G09G 5/38* (2013.01); *G09G 5/10* (2013.01); *G09G 2310/0267* (2013.01); *G09G 2310/0275* (2013.01); *G09G 2320/0626* (2013.01); *G09G 2320/0666* (2013.01); *G09G 2340/0442* (2013.01); *G09G 2380/02* (2013.01)

(58) Field of Classification Search
CPC .... G09G 5/38; G09G 5/10; G09G 2310/0267; G09G 2310/0275; G09G 2320/0626; G09G 2320/0666; G09G 2340/0442; G09G 2380/02
See application file for complete search history.

(56) References Cited

U.S. PATENT DOCUMENTS

| | | | | |
|---|---|---|---|---|
| 9,761,182 | B2 | 9/2017 | Lee et al. | |
| 10,209,742 | B2 | 2/2019 | Shin | |
| 2006/0092321 | A1* | 5/2006 | Ogino | G06T 3/4007 348/441 |
| 2015/0253884 | A1* | 9/2015 | Hwang | G06F 1/1652 345/173 |
| 2016/0078599 | A1* | 3/2016 | Furihata | G06T 3/4007 345/667 |

(Continued)

FOREIGN PATENT DOCUMENTS

| | | | |
|---|---|---|---|
| KR | 10-2015-0105132 | A | 9/2015 |
| KR | 10-2017-0065926 | A | 6/2017 |

(Continued)

*Primary Examiner* — Chanh D Nguyen
*Assistant Examiner* — Ngan T. Pham-Lu
(74) *Attorney, Agent, or Firm* — Lewis Roca Rothgerber Christie LLP

(57) ABSTRACT

A display device includes a display panel including a first display area and a second display area adjacent to the first display area, a processor configured to generate first image data corresponding to the first and second display areas for a first mode, and to generate second image data corresponding to the first display area for a second mode, and a display driver configured to drive the display panel in response to the first image data in the first mode, and to drive the display panel in response to the second image data in the second mode, wherein a supplementary image is displayed in at least a portion of the second display area in the second mode.

17 Claims, 9 Drawing Sheets

(56) References Cited

U.S. PATENT DOCUMENTS

| | | | | |
|---|---|---|---|---|
| 2017/0011714 | A1* | 1/2017 | Eim | G09G 5/38 |
| 2017/0162171 | A1 | 6/2017 | Cho | |
| 2018/0102096 | A1 | 4/2018 | Lee et al. | |
| 2018/0286339 | A1* | 10/2018 | Koudo | G09G 3/3648 |
| 2019/0197960 | A1* | 6/2019 | Kim | G05D 3/10 |

FOREIGN PATENT DOCUMENTS

| | | | |
|---|---|---|---|
| KR | 10-2018-0039797 | A | 4/2018 |
| KR | 10-1848891 | B1 | 4/2018 |

* cited by examiner

MODE1

MODE2

MODE2

DISPLAY DEVICE AND METHOD OF DRIVING THE SAME

CROSS-REFERENCE TO RELATED APPLICATION

This application claims priority to and the benefit of Korean patent application 10-2019-0025751 filed on Mar. 6, 2019 in the Korean Intellectual Property Office, the entire disclosure of which is incorporated herein by reference.

BACKGROUND

1. Field

Aspects of the present disclosure generally relate to a display device and a method of driving the same.

2. Related Art

In a flexible display device such a foldable display device or a rollable display device, at least one area of a display panel is deformed. Accordingly, there have been conducted studies on display devices configured to support an entire display mode for displaying a valid image by entirely using a display area and to support a partial display mode for displaying a valid image by using only a portion of the display area. A display device configured to support a plurality of display modes as described above is efficiently driven depending on a use environment or state, so that the convenience of use can be improved.

SUMMARY

Aspects of embodiments are directed to a display device configured to display a supplementary image at a portion at which a valid image is not displayed in a display area.

Aspects of embodiments are also directed to a method of driving the display device.

According to some embodiments of the present disclosure, there is provided a display device including: a display panel including a first display area and a second display area adjacent to the first display area; a processor configured to generate first image data corresponding to the first and second display areas for a first mode, and to generate second image data corresponding to the first display area for a second mode; and a display driver configured to drive the display panel in response to the first image data in the first mode, and to drive the display panel in response to the second image data in the second mode, wherein a supplementary image is displayed in at least a portion of the second display area in the second mode.

In some embodiments, the supplementary image is shifted according to a scenario in the second display area.

In some embodiments, the supplementary image is shifted, so that each of pixels corresponding to the second display area emits light for an image quality compensation time or more in a shift period.

In some embodiments, the display driver includes an image compensator configured to generate supplementary image data for generating and shifting the supplementary image in the second mode.

In some embodiments, the image compensator is configured to generate the supplementary image data in a first period of the second mode, and to not generate the supplementary image data in a second period of the second mode.

In some embodiments, the supplementary image is displayed while being shifted during the first period of the second mode, and is not displayed in the second display area during the second period of the second mode.

In some embodiments, the image compensator is configured to generate the supplementary image data by using image data of a boundary pixel column among pixel columns provided in the first display area, the boundary pixel column being adjacent to the second display area.

In some embodiments, the image compensator is configured to generate the supplementary image data by using an average of image data of a plurality of boundary pixel columns among pixel columns provided in the first display area, the boundary pixel columns being adjacent to the second display area.

In some embodiments, the image compensator is configured to gradually change a luminance or a color of the supplementary image as it becomes more distant from the first display area.

In some embodiments, the image compensator is configured to decrease the luminance of the supplementary image as it becomes more distant from the first display area.

In some embodiments, the display driver further includes: a data driver configured to generate data signals respectively corresponding to the first image data, the second image data, and the supplementary image data; a scan driver configured to generate a scan signal and to supply the scan signal to the display panel; and a timing controller configured to control driving of the data driver, the scan driver, and the image compensator in response to a control signal from the processor.

In some embodiments, the first display area and the second display area vary when the display panel is deformed.

In some embodiments, the second display area corresponds to a portion that is not exposed to a user when a portion of the display panel is rolled or bent.

In some embodiments, an image compensator is configured to generate supplementary image data by using image data of a boundary pixel column among pixel columns provided in the first display area, the boundary pixel column being adjacent to the second display area.

In some embodiments, the image compensator is configured to shift the supplementary image data such that the supplementary image is shifted in the second display area.

In some embodiments, the display device further includes: a sensor configured to output a sensing signal by sensing a deformation of the display panel.

In some embodiments, the processor is driven in the first mode or the second mode in response to the sensing signal.

According to some embodiments of the present disclosure there is provided a method of driving a display device, the method including: selecting one mode from a first mode and a second mode; displaying a valid image in a first display area and a second display area, corresponding to the first mode; displaying the valid image in the first display area, corresponding to the second mode; generating supplementary image data corresponding to at least a portion of the second display area, corresponding to the second mode; and displaying and shifting a supplementary image in the second display area, corresponding to the supplementary image data.

In some embodiments, the method further includes outputting a sensing signal by sensing a deformation of a display panel including the first and second display areas, wherein one mode is selected from the first and second modes in response to the sensing signal.

In the second mode (partial display mode), the display device and the method of driving the same according to example embodiment may generate a supplementary image displayed at the boundary between the first display area and the second display area is generated, and shift the supplementary image according to a set or predetermined shift scenario. Thus, a degradation deviation (e.g., an image quality deviation or an afterimage) that may occur at the boundary at which the display panel is folded or bent can be substantially reduced or minimized.

Further, a degradation deviation (e.g., viewing of the boundary) in the second display area, which may occur when the static supplementary image is displayed in the vicinity of only the boundary between the first and second display areas, can be substantially reduced or minimized due to the shift of the supplementary image. Accordingly, the image quality of the display device having a flexible display panel such as a foldable display panel, a slidable display panel, or a rollable display panel can be improved.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawings, dimensions may be exaggerated for clarity of illustration. Like reference numerals refer to like elements throughout.

DETAILED DESCRIPTION

Figure 1A:
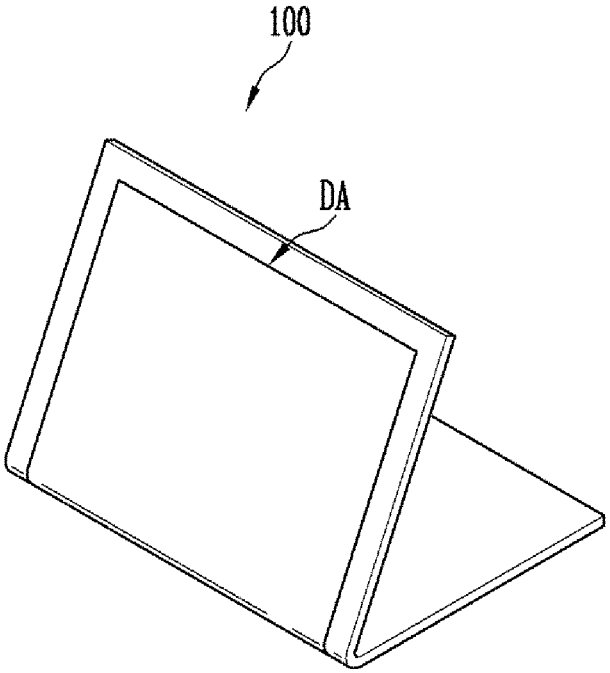
FIGS. 1A-1B are diagrams illustrating an example of a display panel included in a display device in accordance with an example embodiment of the present disclosure.

Hereinafter, exemplary embodiments of the present disclosure will be described in more detail with reference to the accompanying drawings. Throughout the drawings, the same reference numerals are given to the same elements, and their overlapping descriptions may be omitted.

Figure 1B:
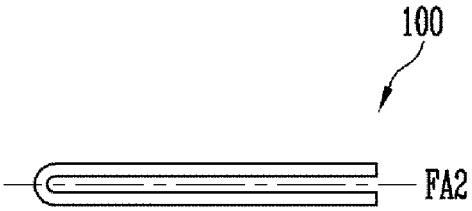

FIGS. 1A and 1B are diagrams illustrating an example of a display panel included in a display device in accordance with an embodiment of the present disclosure.

Referring to FIGS. 1A and 1B, the display panel 100 may include a display area DA in which a plurality of pixels are included.

The display area DA may display an image corresponding to image data.

In some embodiments, the display panel 100 may be a flexible display panel. In an example, at least one area of the display panel 100 may be flexibly implemented such that the display panel 100 is bendable, foldable, and/or rollable.

In some embodiments, the display panel 100 may include a flexible substrate and a plurality of pixels provided on the flexible substrate. However, in the present disclosure, the kind and/or shape of the display panel 100 is not particularly limited.

In some embodiments, the display panel 100 may display a valid image in the entire display area DA in a state in which the display panel 100 is not deformed, such as a state in which the display panel 100 is flatly unfolded. Also, the display panel 100 may display a valid image in only a partial area in the display area DA, for example, a partial area exposed to a user in a state in which the display panel 100 is deformed, such as a state in which the display panel 100 is bent, folded, and/or rolled. Herein, a "valid image" may be an image that is intended to be displayed to a user of the display device.

As shown in FIGS. 1A and 1B, the display panel 100 may be out-folded. For example, the display panel 100 may be out-folded such that the display area DA faces the outside with respect to a folding axis FA2. However, this is merely illustrative, and the display panel 100 may be implemented such that both in-folding and out-folding of the display panel 100 are possible. A folding axis for in-folding and the folding axis FA2 for out-folding may correspond to each other, or may not correspond to each other.

In some embodiments, the display panel 100 may be a slidable display panel. For example, the folding axis FA2 with respect to which the display panel 100 is out-folded may vary. In some examples, a supporting member for supporting the slidable display panel may include a plurality of joints, so that a folding axis of the slidable display panel varies. Accordingly, when the display panel 100 is folded or bent, the size of a first display area in which a valid image is displayed may be changed. The size of a second display area in which the valid image is not displayed may be changed corresponding to a change in the first display area. In an example, when the size of the first display area is increased, the area of the second display area may be decreased.

Figure 2A:
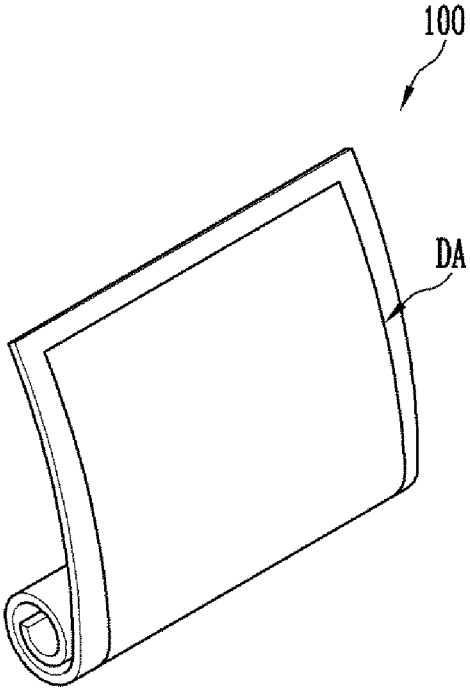
FIGS. 2A-2B are diagrams illustrating an example of a display panel included in a display device in accordance with an example embodiment of the present disclosure.
Figure 2B:
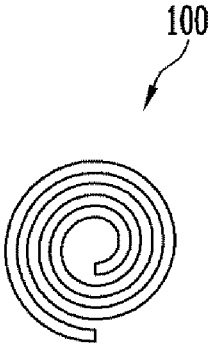

FIGS. 2A and 2B are diagrams illustrating an example of a display panel included in a display device in accordance with an embodiment of the present disclosure.

Referring to FIGS. 2A and 2B, the display panel may be a rollable display panel. In an example, the display panel 100 may be rolled such that a display area DA faces the outside thereof, or may be rolled such that the display area DA faces the inside thereof. That is, at least one area of the display panel 100 may be rolled, and the rolling direction of the display panel 100 is not particularly limited.

In an embodiment, a portion exposed to a user when the display panel 100 is unfolded displays a valid image as a first display area. In addition, another portion of the display panel 100, which is not exposed to the user when the display panel 100 is rolled or bent, does not display any valid image as a second display area.

Figure 3:
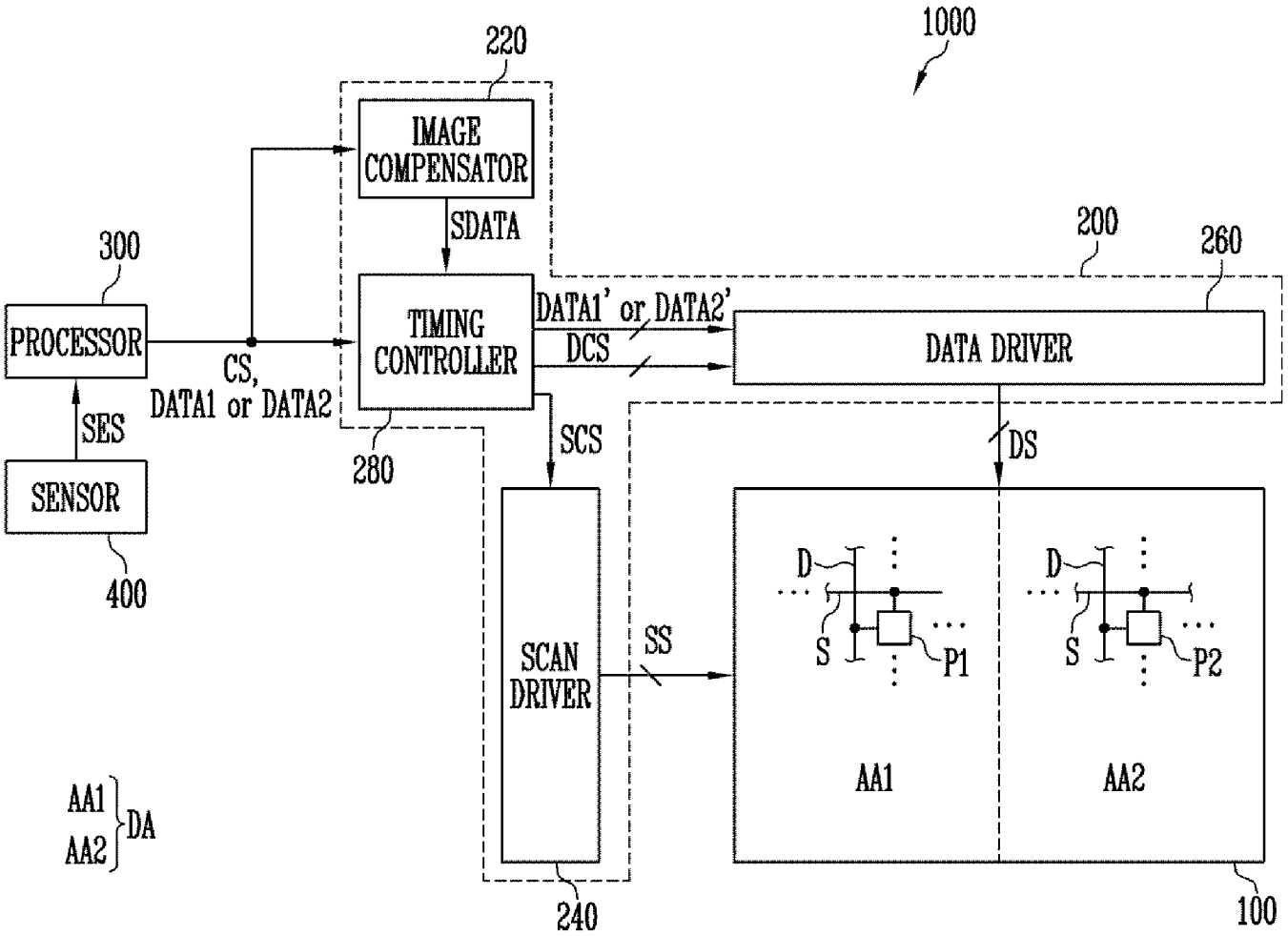
FIG. 3 is a block diagram illustrating a display device in accordance with an example embodiment of the present disclosure.

FIG. 3 is a block diagram illustrating a display device in accordance with an embodiment of the present disclosure.

Referring to FIG. 3, the display device 1000 may include a display panel 100, a display driver 200, and a processor 300. In some embodiments, the display device 1000 may further include a sensor 400 configured to sense a deformation of the display panel 100.

The display panel 100 may be the above-described flexible display panel. That is, the display panel 100 may be configured to be bendable, foldable, and/or rollable.

The display device 1000 having the display panel 100 may display a valid image in different areas (e.g., areas having different sizes, different positions, and/or different ranges) of the entire display area DA depending on a use environment, condition, and/or state. In an example, the display mode of the display panel 100 may be switched to a partial display mode (e.g., a second mode) such that the display panel 100 is driven in the partial display mode in a state in which the display panel 100 is out-folded, and the display panel 100 may display a set or predetermined valid image by using only a partial area exposed to a user in the entire display area DA during a period in which the partial display mode is executed.

Although a case where the display area DA (including AA1 and AA2) has a shape long in the horizontal direction is illustrated in FIG. 3, the present disclosure is not limited thereto. That is, in the present disclosure, the shape or disposition direction of the display area DA is not particularly limited. For example, in some embodiments, the display area DA may have a shape long in the horizontal direction or vertical direction according to a use direction of the display device, and an image displayed in the display area DA may be rotated according to the use direction.

In an embodiment, the display area DA may be divided into a plurality of areas. For example, the display area DA may include a first display area AA1 and a second display area AA2 adjacent thereto. However, this is merely illustrative, and the number of sub-display areas (e.g., the first and second display areas AA1 and AA2) constituting the display area DA is not limited thereto.

In some embodiments, at least one kind of lines selected from scan lines S and data lines D, which are disposed in the first and second display areas AA1 and AA2, may be continuously disposed without interruption between the first and second display areas AA1 and AA2. For example, each scan line S may be continuously disposed between the first and second display areas AA1 and AA2. That is, the scan lines S may extend in a first direction crossing the first and second display areas AA1 and AA2.

In some examples, each data line D may be continuously disposed between the first and second display areas AA1 and AA2. That is, the data lines D may be disposed in a second direction crossing the first and second display areas AA1 and AA2. However, the present disclosure is not limited thereto.

Each of the first and second display areas AA1 and AA2 includes a plurality of first or second pixels P1 or P2. For example, the first display area AA1 may include a plurality of scan lines S, a plurality of data lines D, and a plurality of first pixels P1 coupled to the scan lines S and the data lines D. In addition, the second display area AA2 may include a plurality of scan lines S, a plurality of data lines D, and a plurality of second pixels P2 coupled to the scan lines S and the data lines D.

The display driver 200 may include an image compensator 220, a scan driver 240, a data driver 260, and a timing controller 280. In some embodiments, the image compensator 220 may be provided in the timing controller 280, but the present disclosure is not limited thereto.

In some embodiments, the scan driver 240, the data driver 260, and the timing controller 280 may be integrated together (e.g., be integrally formed). In an example, the display driver 200 may be implemented with a TCON embedded driver IC (TED D-IC) having the timing controller 280 embedded therein. However, the present disclosure is not limited thereto. For example, in another embodiment of the present disclosure, at least one of the scan driver 240, the data driver 260, and the timing controller 280 may be separated.

The scan driver 240 is supplied with a scan control signal SCS from the timing controller 280, and generates a scan signal SS, corresponding to the scan control signal SCS. In some embodiments, the scan control signal SCS may include a gate start pulse and a gate shift clock. In some embodiments, the scan driver 240 may sequentially generate a scan signal SS by sequentially shifting the gate start pulse, using the gate shift clock, and supply the scan signal SS to the scan lines S.

The data driver 260 is supplied with a data control signal DCS and image data DATA2 (or compensated image data). In some embodiments, the data control signal DCS may include a source start pulse, a source shift clock, and a source output enable signal. The data driver 260 generates a data signal DS corresponding to the image data DATA2, using the data control signal DCS, and supplies the data signal DS to the data lines D.

When the display device is driven in an entire display mode (e.g., full display mode; hereinafter, also referred to as a first mode) for displaying a valid image in the entire display area DA, the timing controller 280 may convert input image data (e.g., first image data DATA1) received from the processor 300, and supply converted image data DATA1' to the data driver 260. The first image data DATA1 may correspond to the first and second display areas AA1 and AA2.

When the display device is driven in a partial display mode (hereinafter, referred to as a second mode) for displaying a valid image in only a partial area of the display area DA, for example, the first display area AA1, the timing controller 280 may convert input image data (e.g., second image data DATA2) received from the processor 300, and supply converted image data DATA2' to the data driver 260. The second image data DATA2 may correspond to the first display area AA1.

In the second mode, the image compensator 220 may receive second image data DATA2 from the processor 300. The image compensator 220 may generate supplementary image data SDATA for displaying a supplementary image in at least a portion of the second display area AA2 by using the second image data DATA2. The supplementary image data SDATA may be provided to the timing controller 280. In an embodiment, the timing controller 280 may convert the second image data DATA2 and the supplementary image data SDATA, and supply converted image data DATA2' to the data driver 260. The data driver 260 generates a data signal DS corresponding to the converted image data DATA2', and accordingly, the display panel 100 can display an image corresponding to the converted image data DATA2'.

In an embodiment, the image compensator 220 may generate and/or convert supplementary image data SDATA such that a supplementary image is periodically shifted in the second display area AA2. In an example, the image compensator 220 may generate supplementary image data SDATA by converting the second image data DATA2, or load supplementary image data SDATA set in a memory or the like and provide the supplementary image data SDATA to the timing controller 280.

In some embodiments, the supplementary image may be displayed adjacent to a boundary between the first display area AA1 and the second display area AA2. The supplementary image may be displayed in a portion of the second display area AA2, and be periodically moved in the second display area AA2. The supplementary image may be moved in only a partial range of the second display area AA2, and be sequentially displayed in the entire second display area AA2. In some embodiments, the grayscale and/or luminance of the supplementary image may be determined based on second image data DATA2 corresponding to the first display area AA1. For example, the supplementary image may be a gradation image of which the grayscale and/or luminance is decreased as it becomes distant from the first display area AA1.

Accordingly, a degradation deviation between first and second pixels P1 and P2 disposed in a boundary area between a valid display area (e.g., the first display area AA1) and an invalid display area (e.g., the second display area AA2) can be decreased or reduced during a period in which the display device 1000 is driven in the second mode. In addition, all pixels in the entire second display area AA2 can emit light for a certain time (e.g., a set or predetermined image quality compensation time) or more due to the shift of the supplementary image during the second mode. Thus, a degradation deviation between the entire second display area AA2 and the entire first display area AA1 can be decreased. Accordingly, viewing of the boundary between the first display area AA1 and the second display area AA2 can be minimized or prevented even during a period in which the display device is driven in the first mode, and an image quality deviation between the first display area AA1 and the second display area AA2 can be reduced or minimized.

Although a case where the image compensator 220 is separated from the timing controller 280, the data driver 260, etc. is illustrated in FIG. 3, the present disclosure is not limited thereto. For example, at least a portion of the image compensator 220 may be provided in the timing controller 280 and/or the data driver 260. In some examples, the image compensator 220 may be provided in the processor 300.

The processor 300 generates a control signal CS for driving the display driver 200 and/or the display panel 100 and input image data DATA1 or DATA2. In some embodiments, the processor 300 may be an application processor of a mobile device. However, the kind of processor 300 is not limited thereto, and the processor 300 may be another kind of processor corresponding to the display device.

The processor 300 may select one of the first mode (or the full/entire display mode) and the second mode (or partial display mode), and control the display driver 200 and/or the display panel 100 according to the selected mode. For example, the processor 300 may supply first image data DATA1 corresponding to the entire display area DA and a control signal CS for controlling the display driver 200 to the display driver 200, corresponding to the first mode. In some examples, the processor 300 may supply second image data DATA2 corresponding to the first display area AA1 and a control signal CS to the display driver 200, corresponding to the second mode. For convenience, in the embodiment of the present disclosure, the display mode of the display device is generally divided into two modes, but the present disclosure is not limited thereto. For example, the second mode may be segmented into a plurality of partial display modes for partially a valid image in areas having different positions and/or areas having different ranges. The display mode of the display device may be divided into at least three modes.

In some embodiments, a sensing signal SES may include information on a deformation of the display panel 100, a deformation degree and/or a deformation area. The processor 300 may select any one mode and/or any one valid display area, corresponding to the sensing signal SES, and operate corresponding to the selected mode. For example, the processor 300 may generate a selection signal corresponding to the selected mode, and generate second image data DATA2 by matching a set or predetermined image to be displayed to the selected valid display area.

In some embodiments, the selection signal may be included in the control signal CS to be supplied to the display driver 200. Then, the display driver 200 may operate in the first mode or the second mode, corresponding to the selection signal. In an example, the selection signal may control an operation of the image compensator 220.

The sensor 400 may include a sensing element for sensing a use environment and/or a state of the display device. In an example, the sensor 400 may include a sensing element that is provided at the inside or periphery of the display panel 100 to sense a deformation of the display panel 100 and outputs a sensing signal SES corresponding to the sensed deformation. In the embodiment of the present disclosure, the kind of sensor 400 is not particularly limited. That is, the sensor 400 may be implemented with various types of sensing elements currently known in the art, such as a bending sensor, a folding sensor, and an acceleration sensor.

As described above, the display device in accordance with the embodiment of the present disclosure can display a supplementary image periodically shifted in the second area AA2 (e.g., the invalid display area) during a period the display device is driving in the second mode (or partial display mode). Thus, occurrence of a rapid luminance change between the valid display area and the invalid display area can be prevented. Accordingly, a degradation deviation between the pixels of not only the boundary area between two adjacent display areas, for example, the first and second display areas AA1 and AA2 but also the entire display area can be decreased or reduced. Thus, although the display mode of the display device 1000 is switched to the first mode after the display device 1000 is driven in the second mode for a long time, an afterimage of the display area DA can be prevented or minimized, and the image quality (or image quality deviation) of the display device 1000 can be improved.

Figure 4A:
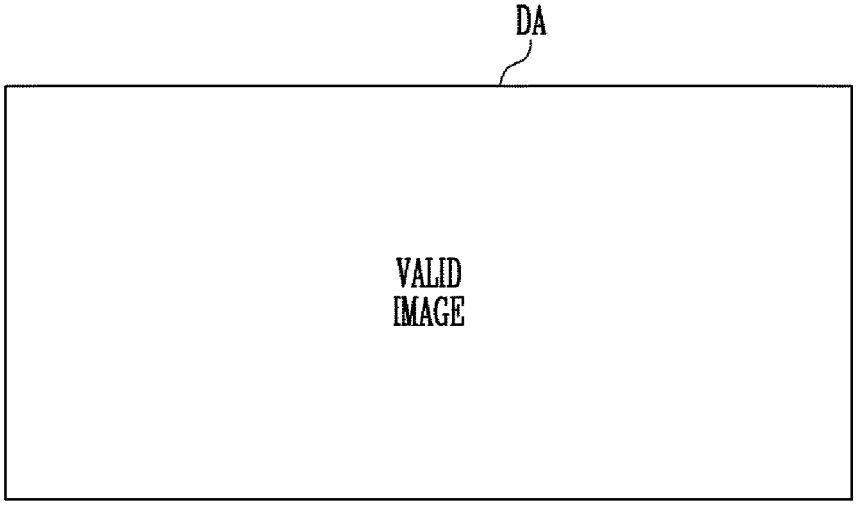
FIGS. 4A-4C are diagrams illustrating an example of an image displayed in a display area of a display panel according to a mode of the display device shown in FIG. 3.
Figure 4B:
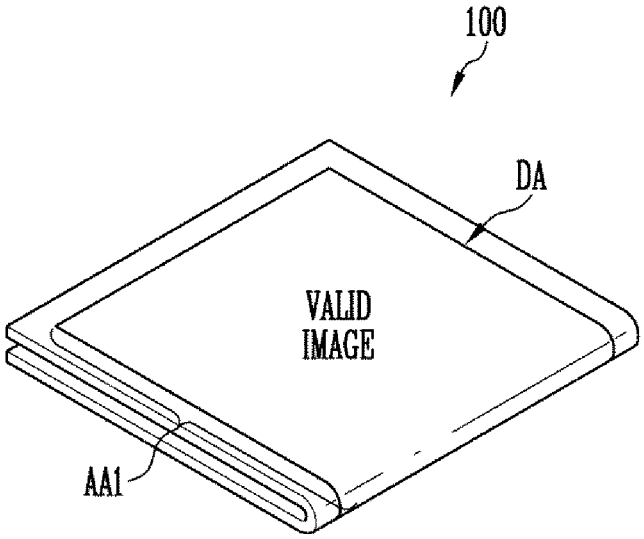
Figure 4C:
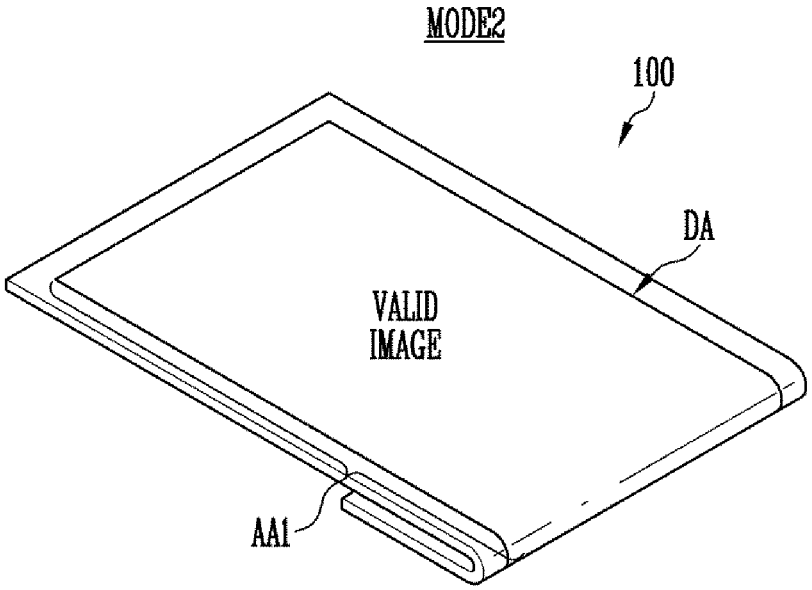

FIGS. 4A to 4C are diagrams illustrating an example of an image displayed in the display area of the display panel according to a mode of the display device shown in FIG. 3.

Referring to FIGS. 3 to 4C, the display device may be driven in a first mode MODE1 or a second mode MODE2 depending on a set or predetermined use environment, a set or predetermined state, and/or a set or predetermined condition.

In an embodiment, the display device may be driven in the first mode MODE1 in a state in which the display panel 100 (or the display area DA) is completely unfolded. For example, when the sensor 400 does not sense a deformation (bending or folding) of the display panel 100, the display device may be driven in the first mode MODE1.

The processor 300 may set the entire display area DA including the first and second display areas AA1 and AA2 as a valid display area, corresponding to the first mode MODE1, and generate first image data DATA1 corresponding to the entire display area DA.

The display driver 200 may generate a first data signal corresponding to the first image data DATA1, and supply the first data signal to the first and second pixels P1 and P2 through the data lines D. Accordingly, as shown in FIG. 4A, a set or predetermined valid image corresponding to the first image data DATA1 can be displayed in the entire display area DA.

In an embodiment, the display device may be driven in the second mode MODE2 in a state in which the display panel 100 (or the display area DA) is deformed. For example, when the sensor 400 senses a deformation (bending or folding) of the display panel 100, the display device may be driven in the second mode MODE2. Specifically, when the display panel 100 is out-folded at a set or predetermined rotation angle or more, the sensor 400 may output a sensing signal SES.

In some examples, the sensor 400 may detect a folded portion of the display panel 100. For example, when the display panel 100 is a slidable display panel, the sensor 400 may sense a portion folded or bent at a set or predetermined rotation angle or more (i.e., a deformed portion), and the sensing signal SES may include a position information of the deformed portion of the display panel 100. Accordingly, the first display area AA1 and the second display area AA2 can be determined based on the position information.

In an embodiment, the processor 300 may determine the first display area AA1 and the second display area AA2, corresponding to the sensing signal SES and the second mode MODE2. A valid image is displayed in the first display area AA1. The second display area AA2 may correspond to a portion that is not exposed to a user when a portion of the display panel 100 is rolled or bent.

The processor 300 may match an image to be displayed to the first display area AA1, and generate second image data DATA2 corresponding to the first display area AA1. Accordingly, as shown in FIGS. 4B and 4C, an image (valid image) to be displayed can be displayed in the first display area AA1.

In the second mode MODE2, the image compensator 220 may generate supplementary image data SDATA corresponding a supplementary image displayed in the second display area AA2, based on a control signal CS. The image compensator 220 may generate supplementary image data SDATA by using the second image data DATA2, or load pre-stored supplementary image data SDATA. Also, the image compensator 220 may convert the supplementary image data SDATA such that the supplementary image is shifted in the second display area AA2. Accordingly, the supplementary image can be displayed while being moved in the second display area AA2 during the second mode MODE2.

In an embodiment, in the second mode MODE2, the image compensator 220 may generate supplementary image data SDATA by using image data of boundary pixel columns adjacent to the second display area AA2 among pixel columns provided in the first display area AA1. For example, the supplementary image data SDATA may be identical to image data of the last pixel column most adjacent to the second display area AA2 among the boundary pixel columns. In some examples, the supplementary image data SDATA may be set to an average value of image data of a plurality of boundary pixel columns. In some examples, the supplementary image data SDATA may be generated to correspond to the supplementary image having a color or luminance gradually changed as it becomes distant from the first display area AA1. Although a case where the supplementary image and the supplementary image data SDATA are generated and moved with respect to a pixel column is illustrated for convenience of description, the supplementary image and the supplementary image data SDATA is not limited thereto. For example, the supplementary image data SDATA may be generated in units of pixel rows according to the arrangement of the data lines D, the deformation shape of the display panel 100, etc.

Figure 5A:
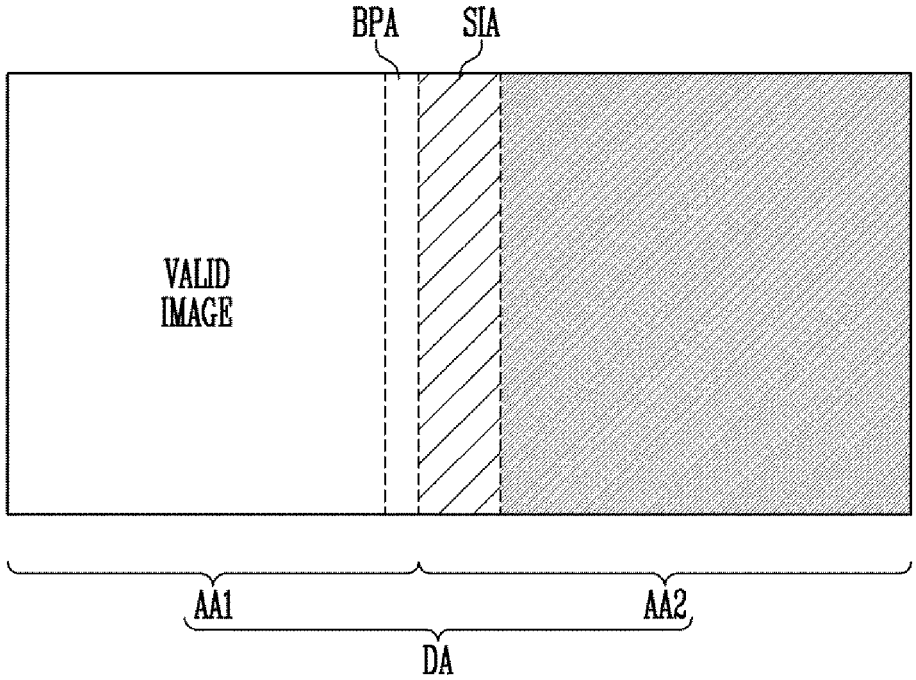
FIGS. 5A-5B are diagrams illustrating an example of an image displayed on the display panel when the display device shown in FIG. 3 is driven in a second mode.
Figure 5B:
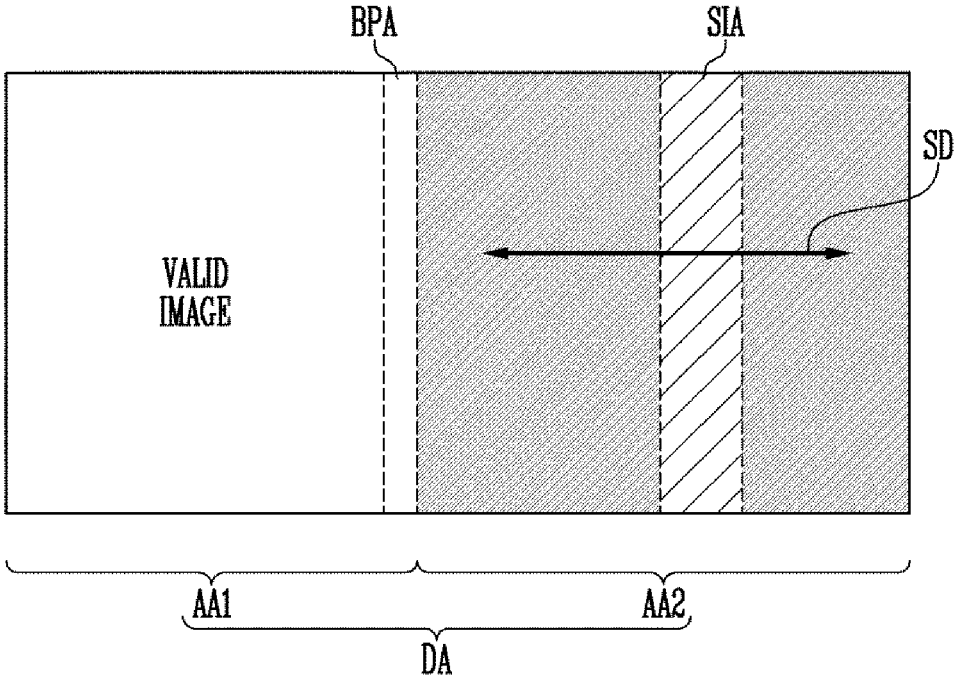

FIGS. 5A and 5B are diagrams illustrating an example of an image displayed on the display panel when the display device shown in FIG. 3 is driven in the second mode.

Referring to FIGS. 3, 5A, and 5B, when the display device 1000 is driven in the second mode, the display area DA may be divided into a first display area AA1 in which a valid image is displayed and a second display area AA2 in which an invalid image is displayed. A supplementary image SIA may be included in the invalid image.

In the second mode, the image compensator 220 may generate supplementary image data SDATA corresponding to the supplementary image SIA. Also, the image compensator 220 may shift the supplementary image data SDATA such that the supplementary image SIA is shifted according to a set or predetermined scenario in the second display area AA2. For example, the supplementary image SIA may be moved in the second display area AA2 according to a set or predetermined shift period and a set or predetermined shift direction D. Although a case where the shift direction D is a horizontal direction is illustrated in FIGS. 5A and 5B, the shift direction SD and a shift pattern are not limited thereto. For example, the shift pattern may be variously set, including a vertical movement pattern, a spiral movement pattern, and the like.

When the supplementary image SIA is shifted, each of the pixels included in the second display area AA2 can emit light for a set or predetermined image quality compensation time in a set or predetermined shift period. For example, in the shift period, the supplementary image SIA may be moved in the entire range of the second display area AA2. As shown in FIGS. 5A and 5B, the supplementary image SIA is an image displayed on a plurality of pixel columns and all pixel rows corresponding thereto, and may be moved to the left or right at a set or predetermined pixel interval. Accordingly, the supplementary image SIA can be displayed in the entire second display area AA2 with a time difference.

In an embodiment, the supplementary image SIA may be an image set regardless of the grayscale and/or luminance of the first display area AA1. For example, the supplementary image data SDATA may have a set or predetermined luminance and a set or predetermined grayscale value, and the supplementary image SIA may be displayed regardless of an image corresponding to the second image data DATA2.

In some embodiments, the image compensator 220 may generate supplementary image data SDATA by using image data of a boundary pixel column BPA adjacent to the second display area AA2 among the pixel columns provided in the first display area AA1. The boundary pixel column BPA may correspond to one pixel column, and correspond to a plurality of consecutive pixel columns. The supplementary image SIA includes a plurality of pixel columns.

For example, when the image compensator 220 uses image data corresponding to one boundary pixel column BPA, image data of each of the pixel columns included in the supplementary image data SDATA may be identical to that of the boundary pixel column BPA. The image compensator 220 may extract image data of the boundary pixel column, and generate supplementary image data SDATA corresponding to the supplementary image SIA by copying the corresponding image data multiple times. That is, the supplementary image data SDATA may be image data obtained by copying the image data of the boundary pixel column BPA multiple times. The image compensator 220 may shift the supplementary image data SDATA generated in the above-described manner to a set or predetermined data line position for each set or predetermined time.

In an embodiment, the image compensator 220 may generate supplementary image data SDATA by using an average of image data of at least one boundary pixel column BPA. The image compensator 220 includes a data averaging unit. For example, the data averaging unit (or the image compensator 220) may calculate an average of grayscale values of image data included in a plurality of boundary pixels BPA, and determine the average of the grayscale values as the supplementary image data SDATA. Accordingly, the supplementary image SIA can be an image having a uniform grayscale corresponding to the average of the grayscale values.

Although a case where the supplementary image SIA is moved throughout the entire second display area AA2 is illustrated in FIGS. 5A and 5B, the present disclosure is not limited thereto. For example, the supplementary image SIA may be moved in a set or predetermined pattern to an intermediate area of the second display area AA2 from the boundary between the first display area AA1 and the second display area AA2.

As described above, in the second mode, the display device in accordance with the embodiment of the present disclosure can generate supplementary image SIA displayed at the boundary between the first display area AA1 and the second display area AA2, and shift the supplementary image SIA according to a set or predetermined shift scenario. Thus, a degradation deviation (e.g., an image quality deviation or an afterimage) that may occur at the boundary between the first display area AA1 and the second display area AA2 can be reduced or minimized. Further, a degradation deviation (e.g., viewing of the boundary) in the second display area AA2, which may occur when the static supplementary image SIA is displayed in the vicinity of only the boundary between the first and second display areas AA1 and AA2, can be reduced or minimized due to the shift of the supplementary image SIA.

Figure 6:
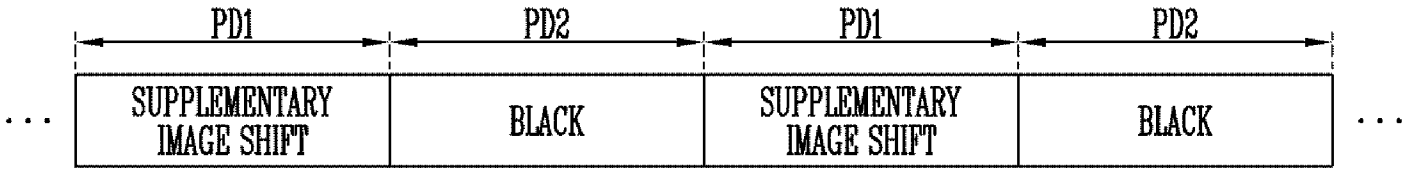
FIG. 6 is a diagram illustrating an example of driving of the display device shown in FIG. 3 in the second mode.

FIG. 6 is a diagram illustrating an example of driving of the display device shown in FIG. 3 in the second mode.

Referring to FIGS. 3, 5A, 5B, and 6, the display device 1000 driven in the second mode MODE2 may control a period in which a supplementary image SIA is displayed and shifted.

In an embodiment, the image compensator 220 generates supplementary image data SDATA in a first period PD1 of the second mode MODE2, and does not generate the supplementary image data SDATA in a second period PD2 of the second mode MODE2. For example, the image compensator 220 or the timing controller 280 may include a frame counter, and determine whether the supplementary image data SDATA is to be generated by distinguishing the first and second periods PD1 and PD2 from each other, using the frame counter. In some embodiments, the image compensator 220 does not operate in the second period PD2.

In response to an operation of the image compensator 220, the supplementary image SIA is shifted and displayed during the first period PD1 of the second mode MODE2, and is not displayed in the second display area AA2 during the second period PD2 of the second mode MODE2.

The first period PD1 may correspond to a time for which a shift scenario is repeated at a set or predetermined number of times. For example, a shift scenario where the supplementary image SIA reciprocates between the first pixel column of the second display area AA2, which is adjacent to the boundary pixel column BPA, and the last pixel column of the second display area AA2 may be repeated multiple times during the first period PD1.

In some embodiments, the supplementary image SIA unrelated to an image of the first display area AA1 may be displayed in the first period PD1.

In the second period PD2, image data corresponding to the second display area AA2 is not generated. Therefore, the second display area AA2 may be in a turn-off state during the second period PD2.

As described above, the driving of the image compensator 220 for generating the supplementary image SIA is periodically turned off in the second mode MODE2, so that power consumption can be reduced.

Figure 7A:
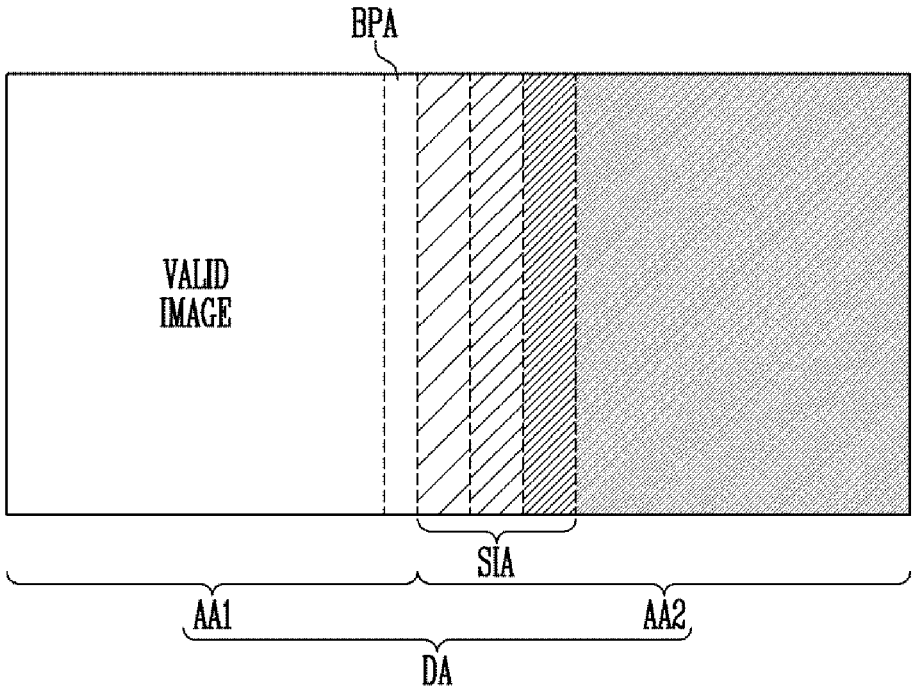
FIGS. 7A-7B are diagrams illustrating an example of an image displayed on the display panel when the display device shown in FIG. 3 is driven in the second mode.
Figure 7B:
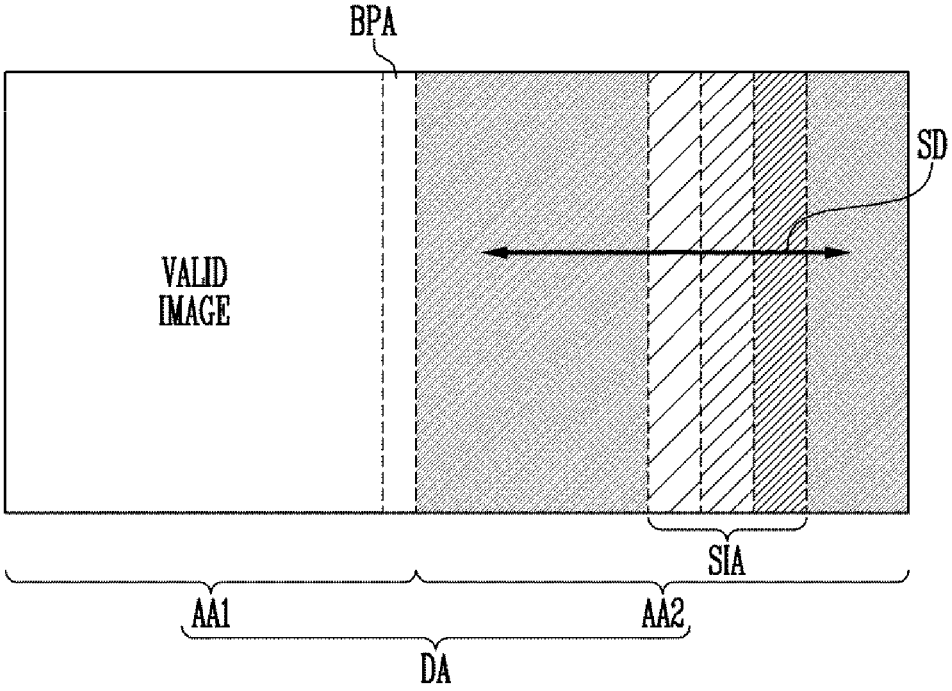

FIGS. 7A and 7B are diagrams illustrating an example of an image displayed on the display panel when the display device shown in FIG. 3 is driven in the second mode.

The display device shown in FIGS. 7A and 7B includes a configuration and an operating scheme, which are substantially identical or similar to those of the display device shown in FIGS. 5A and 5B, except a method of generating supplementary image data SDATA. Therefore, in FIGS. 7A and 7B, components similar or identical to those shown in FIGS. 5A and 5B are designated by like reference numerals, and their overlapping descriptions may be omitted.

Referring to FIGS. 7A and 7B, the image compensator 220 may generate supplementary image data SDATA corresponding to a supplementary image SIA, based on image data of the boundary pixel column BPA.

In some embodiments, the image compensator 220 may generate supplementary image data by using an average of image data of boundary pixel columns BPA. The image compensator 220 may generate supplementary image data such that the luminance or color of the supplementary image SIA is gradually changed as it becomes distant from the first display area AA1.

When the supplementary image SIA includes first to kth (k is a natural number greater than 1) pixel columns, a pixel column (hereinafter, referred to as the first pixel column) of the supplementary image, which is most adjacent to the boundary pixel column BPA, may correspond to an average value of the image data of the boundary pixel columns BPA, and a pixel column (hereinafter, referred to as the kth pixel column) of the supplementary image SIA, which is located most distant from the boundary pixel column BPA, may have a value different from the average value of the image data of the boundary pixel columns BPA. For example, the luminance or color of the supplementary image SIA may be gradually decreased as it approaches from the first pixel column to the kth pixel column. The image compensator 220 may determine supplementary image data SDATA corresponding to the second to kth pixel columns by applying a set or predetermined weighted value to a grayscale value of supplementary image data SDATA corresponding to the first pixel column. For example, the weighted value may be set such that the grayscale or luminance of the supplementary image SIA is gradually decreased as it becomes distant from the first display area AA1. That is, the weighted value may be changed in a set or predetermined pixel column unit.

However, this is merely illustrative, and the grayscale or luminance of the supplementary image SIA may be gradually increased as it approaches from the first pixel column to the kth pixel column. In addition, the supplementary image SIA and the supplementary image data SDATA may be set regardless of the grayscale value of the boundary pixel column BPA or the average grayscale value of the boundary pixel columns BPA.

Figure 8:
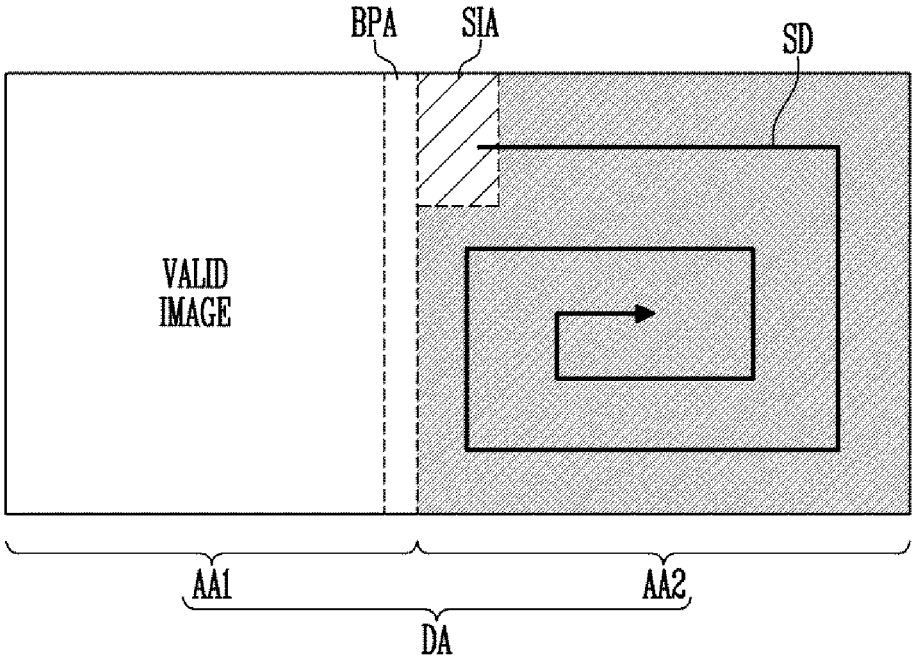
FIG. 8 is a diagram illustrating an image displayed on the display panel when the display device shown in FIG. 3 is driven in the second mode.

FIG. 8 is a diagram illustrating an image displayed on the display panel when the display device shown in FIG. 3 is driven in the second mode.

The display device shown in FIG. 8 is substantially identical to the display device shown in FIGS. 5A and 5B, except the shape and shift pattern of a supplementary image. Therefore, in FIG. 8, components similar or identical to those shown in FIGS. 5A and 5B are designated by like reference numerals, and their overlapping descriptions may be omitted.

Referring to FIG. 8, a supplementary image SIA may correspond to portions of some pixel columns included in the second display area AA2 and portions of pixel rows overlapping with the pixel columns. Although a case where the supplementary image SIA has a quadrangular shape is illustrated in FIG. 8, the size and shape of the supplementary image SIA are not limited thereto. For example, the supplementary image SIA may be an image having a circular shape, an elliptical shape, or the like, which is displayed in a portion of the second display area AA2.

The supplementary image SIA may be moved in a spiral shift pattern in the second mode. However, this is merely illustrative, and the shift pattern of the supplementary image SIA is not limited thereto.

Figure 9:
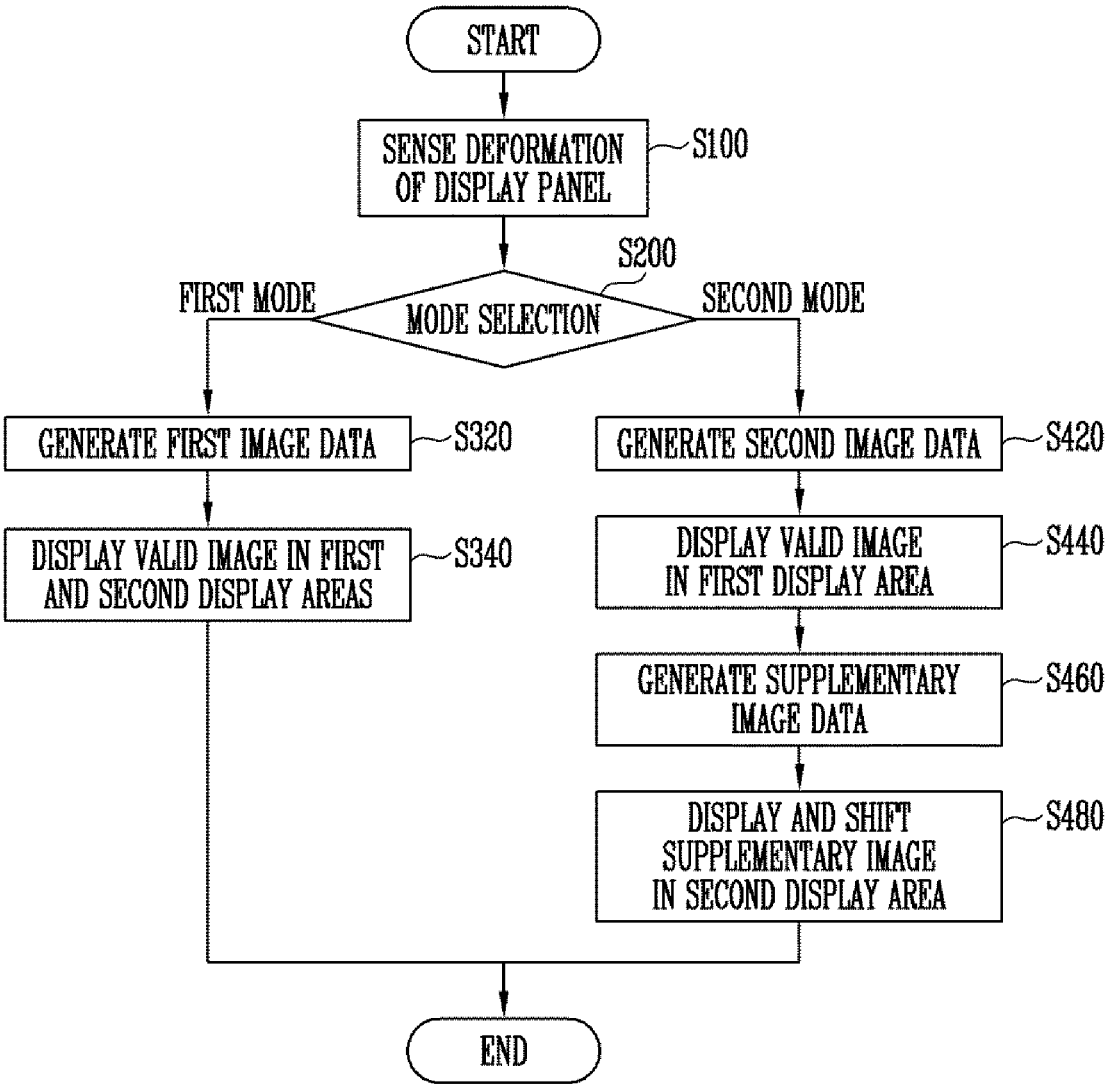
FIG. 9 is a flowchart illustrating a method of driving a display device in accordance with an example embodiment of the present disclosure.

FIG. 9 is a flowchart illustrating a method of driving a display device in accordance with an embodiment of the present disclosure.

Referring to FIGS. 1A to 9, the method of driving the display device 1000 may select one mode selected from the first mode MODE1 and the second mode MODE2 (S200). A valid image may be displayed in the first area AA1 and the second display area AA2, corresponding to the first mode MODE1 (S320 and S340), and a valid image may be displayed in the first display area AA1, corresponding to the second mode MODE2 (S420 and S440). In addition, supplementary image data SDATA corresponding to at least a portion of the second display area AA2 may be generated corresponding to the second mode MODE2 (S460), and a supplementary image SIA may be displayed while being shifted in the second display area AA2, corresponding to the supplementary image data SDATA (S480).

One mode may be selected from the first mode MODE1 and the second mode MODE2 (S200). In an embodiment, a deformation of the display panel 100 including the first and second display areas AA1 and AA2 may be sensed (S100), and a sensing signal may be output. The display device 1000 may select one mode from the first and second modes MODE1 and MODE2, corresponding to the sensing signal. For example, when the display panel 100 is folded or bent to a set or predetermined angle or more, the second mode MODE2 may be selected, and the first mode MODE1 may be selected otherwise.

In the second mode MODE2, supplementary image data SDATA may be generated so as to display a supplementary image SIA in the second display area AA2 (S460), and the supplementary image SIA may be displayed while being shifted according to a set or predetermined shift scenario in the second display area AA2, corresponding to the supplementary image data SDATA.

The method of driving the display device has been described in detail with reference to FIGS. 1A to 8, and therefore, overlapping descriptions may be omitted.

As described above, in the display device and the method of driving the same in accordance with the embodiment of the present disclosure, in the second mode (partial display mode), a supplementary image SIA displayed at the boundary between the first display area AA1 and the second display area AA2 is generated, and is shifted according to a set or predetermined shift scenario. Thus, a degradation deviation (e.g., an image quality deviation or an afterimage) that may occur at the boundary between the first display area AA1 and the second display area AA2 can be reduced or minimized.

Further, a degradation deviation (e.g., viewing of the boundary) in the second display area AA2, which may occur when the static supplementary image SIA is displayed in the vicinity of only the boundary between the first and second display areas AA1 and AA2, can be reduced or minimized due to the shift of the supplementary image SIA. Accordingly, the image quality of the display device having a flexible display panel such as a foldable display panel, a slidable display panel, or a rollable display panel can be improved.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as defined by the following claims, and equivalents thereof.

What is claimed is:

1. A display device comprising:

a display panel comprising a first display area and a second display area adjacent to the first display area;

a processor configured to generate first image data corresponding to the first and second display areas for a first mode, and to generate second image data corresponding to the first display area for a second mode; and a display driver configured to drive the display panel in response to the first image data in the first mode, and to drive the display panel in response to the second image data in the second mode, wherein the display driver comprises an image compensator configured to generate supplementary image data based on the second image data to generate and periodically shift a supplementary image in at least a portion of the second display area that is a folded, rolled, or bent display area in the second mode, wherein, in the second mode, the supplemental image is displayed and periodically shifted on a non-visible portion of the second display area that is not exposed to a user and is overlapped by another portion of the display panel that is folded, rolled, or bent over the non-visible portion, and wherein the supplementary image corresponds to image data of a boundary pixel column at a boundary of the first and second display areas, and remains the same size as the supplementary image is shifted across the non-visible portion of the second display area during the second mode.

2. The display device of claim 1, wherein the supplementary image is shifted according to a scenario in the second display area.

3. The display device of claim 1, wherein the supplementary image is shifted, so that each of pixels corresponding to the second display area emits light for an image quality compensation time or more in a shift period.

4. The display device of claim 1, wherein the image compensator is configured to generate the supplementary image data in a first period of the second mode, and to not generate the supplementary image data in a second period of the second mode.

5. The display device of claim 4, wherein the supplementary image is displayed while being shifted during the first period of the second mode, and is not displayed in the second display area during the second period of the second mode.

6. The display device of claim 1, wherein the image compensator is configured to generate the supplementary image data by using the image data of the boundary pixel column among pixel columns provided in the first display area, the boundary pixel column being adjacent to the second display area.

7. The display device of claim 1, wherein the image compensator is configured to generate the supplementary image data by using an average of image data of a plurality of boundary pixel columns among pixel columns provided in the first display area, the boundary pixel columns being adjacent to the second display area.

8. The display device of claim 1, wherein the image compensator is configured to gradually change a luminance or a color of the supplementary image as it becomes more distant from the first display area.

9. The display device of claim 8, wherein the image compensator is configured to decrease the luminance of the supplementary image as it becomes more distant from the first display area.

10. The display device of claim 1, wherein the display driver further comprises:

a data driver configured to generate data signals respectively corresponding to the first image data, the second image data, and the supplementary image data;

a scan driver configured to generate a scan signal and to supply the scan signal to the display panel; and a timing controller configured to control driving of the data driver, the scan driver, and the image compensator in response to a control signal from the processor.

11. The display device of claim 1, wherein the first display area and the second display area vary when the display panel is deformed.

12. The display device of claim 1, wherein the image compensator is configured to generate the supplementary image data by using the image data of the boundary pixel column among pixel columns provided in the first display area, the boundary pixel column being adjacent to the second display area.

13. The display device of claim 12, wherein the image compensator is configured to shift the supplementary image data such that the supplementary image is shifted in the second display area.

14. The display device of claim 1, further comprising:

a sensor configured to output a sensing signal by sensing a deformation of the display panel.

15. The display device of claim 14, wherein the processor is driven in the first mode or the second mode in response to the sensing signal.

16. A method of driving a display device, the method comprising:

selecting one mode from a first mode and a second mode;

displaying a valid image in a first display area and a second display area, corresponding to the first mode;

displaying the valid image in the first display area, corresponding to the second mode;

generating supplementary image data corresponding to at least a portion of the second display area that is a folded, rolled, or bent display area in the second mode, corresponding to the second mode; and displaying and periodically shifting a supplementary image in the second display area, corresponding to the supplementary image data, wherein, in the second mode, the supplemental image is displayed and periodically shifted on a non-visible portion of the second display area that is not exposed to a user and is overlapped by another portion of the display device that is folded, rolled, or bent over the non-visible portion, and wherein the supplementary image corresponds to image data of a boundary pixel column at a boundary of the first and second display areas, and remains the same size as the supplementary image is shifted across the non-visible portion of the second display area during the second mode.

17. The method of claim 16, further comprising:

outputting a sensing signal by sensing a deformation of a display panel comprising the first and second display areas, wherein one mode is selected from the first and second modes in response to the sensing signal.

* * * * *